US007169029B2

(12) United States Patent
Petersen et al.

(10) Patent No.: US 7,169,029 B2
(45) Date of Patent: Jan. 30, 2007

(54) RESILIENT STRUCTURED SANDING ARTICLE

(75) Inventors: John G. Petersen, Center City, MN (US); Chris A. Minick, Stillwater, MN (US); Jonathan M. Lise, Woodbury, MN (US); James F. Pitzen, Maplewood, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 11/016,141

(22) Filed: Dec. 16, 2004

(65) Prior Publication Data

US 2006/0135050 A1 Jun. 22, 2006

(51) Int. Cl.
*B24D 15/00* (2006.01)

(52) U.S. Cl. ..... 451/523; 451/527; 451/529; 451/533; 51/295

(58) Field of Classification Search ..... 451/523, 451/527, 529, 530, 533, 539; 51/295–297, 51/299, 300
See application file for complete search history.

(56) References Cited

U.S. PATENT DOCUMENTS

| | | | | |
|---|---|---|---|---|
| 2,011,911 | A | | 4/1935 | Wooddell et al. |
| 2,001,911 | A | * | 5/1935 | Wooddell et al. ..... 451/529 |
| 3,041,158 | A | | 6/1962 | Rowse et al. |
| 3,991,527 | A | * | 11/1976 | Maran ..... 451/529 |
| 4,055,029 | A | | 10/1977 | Kalbow |
| 4,111,666 | A | | 9/1978 | Kalbow |
| 4,255,164 | A | | 3/1981 | Butzke et al. |
| 4,264,337 | A | | 4/1981 | Fenster et al. |
| 4,314,827 | A | | 2/1982 | Leithelser et al. |
| 4,623,364 | A | | 11/1986 | Cottringer et al. |
| 4,652,274 | A | | 3/1987 | Boettcher et al. |
| 4,652,275 | A | | 3/1987 | Bloecher et al. |
| 4,714,644 | A | | 12/1987 | Rich |
| 4,735,632 | A | | 4/1988 | Oxman et al. |
| 4,744,802 | A | | 5/1988 | Schwabel |
| 4,751,138 | A | | 6/1988 | Tumey et al. |
| 4,770,671 | A | | 9/1988 | Monroe et al. |
| 4,881,951 | A | | 11/1989 | Wood et al. |
| 4,887,396 | A | | 12/1989 | Luklanoff |
| 4,903,440 | A | | 2/1990 | Larson et al. |
| 4,950,696 | A | | 8/1990 | Palazotto et al. |
| 4,985,340 | A | | 1/1991 | Palazzotto et al. |
| 4,997,461 | A | | 3/1991 | Markhoff-Matheny et al. |
| 5,009,675 | A | | 4/1991 | Kunz et al. |
| 5,011,508 | A | | 4/1991 | Wald et al. |
| 5,042,991 | A | | 8/1991 | Kunz et al. |
| 5,085,671 | A | | 2/1992 | Martin et al. |
| 5,190,568 | A | | 3/1993 | Tselesin |
| 5,213,951 | A | | 5/1993 | Delfino |
| 5,236,472 | A | | 8/1993 | Kirk et al. |
| 5,256,170 | A | | 10/1993 | Harmer et al. |

(Continued)

FOREIGN PATENT DOCUMENTS

| | | |
|---|---|---|
| EP | 0 706 859 A1 | 4/1996 |

(Continued)

*Primary Examiner*—Eileen P. Morgan
(74) *Attorney, Agent, or Firm*—David B. Patchett

(57) ABSTRACT

A resilient hand-held abrasive article suitable, for example, for woodworking, includes a plurality of separated raised abrasive surfaces to allow the article to more effectively conform to a contoured surface. A method of making such an abrasive article is also disclosed.

39 Claims, 5 Drawing Sheets

U.S. PATENT DOCUMENTS

| | | | | |
|---|---|---|---|---|
| 5,378,252 | A | 1/1995 | Follensbee | |
| 5,674,122 | A | 10/1997 | Krech | |
| 5,782,682 | A * | 7/1998 | Han et al. | 451/548 |
| 5,820,450 | A * | 10/1998 | Calhoun | 451/530 |
| 5,910,471 | A * | 6/1999 | Christianson et al. | 51/295 |
| 5,975,988 | A | 11/1999 | Christianson | |
| 6,059,850 | A | 5/2000 | Lise et al. | |
| 6,332,832 | B1 * | 12/2001 | Suzuki | 451/41 |
| 6,488,575 | B2 * | 12/2002 | Agarwal et al. | 451/527 |
| 6,612,916 | B2 * | 9/2003 | Kollodge et al. | 451/527 |
| 6,613,113 | B2 | 9/2003 | Minick et al. | |
| 6,837,781 | B2 * | 1/2005 | Hishiki | 451/527 |
| 2003/0150169 | A1 | 8/2003 | Annen | |

FOREIGN PATENT DOCUMENTS

| | | |
|---|---|---|
| WO | WO 01/41975 A1 | 6/2001 |

* cited by examiner

RESILIENT STRUCTURED SANDING ARTICLE

FIELD

The present invention relates generally to abrasive articles and, more particularly, to hand held, resilient, sanding articles commonly referred to as sanding sponges.

BACKGROUND

Resilient abrasive articles are known. U.S. Pat. No. 6,059,850 (Lise et al.), for example, discloses a resilient abrasive article including a resilient elongatable substrate, abrasive particles adhesively bonded to the substrate with a flexible make coat, and a hard size coat applied over the abrasive particles and the flexible make coat.

U.S. Pat. No. 4,887,396 (Lukianoff) discloses a disposable sanding device fabricated from a block of lightweight, resilient material capable of substantially retaining its shape under applied sanding pressure, and has a relatively permanent abrasive surface provided on the faces of the block. Preferably, the abrasive surface on the block faces consists of an abrasive coating which has a built-up in the corner areas of the block to extend the life of the corner sanding surfaces. The block can be provided with an abrasive coated surface specifically contoured to match a particular surface shape to be sanded.

The industry, however, is always seeking improved abrasive articles. It would therefore be desirable to provide an inexpensive resilient abrasive article with improved abrading characteristics, improved durability, and improved ability to abrade contoured or profiled surfaces such as wood molding. More specifically, it would be desirable to provide an inexpensive, disposable, resilient, hand-held abrasive article that is more versatile than existing sanding sponges and is able to sand a variety of profiled surfaces such as different sizes and styles of wood molding and trim.

SUMMARY OF THE INVENTION

In one aspect, the present invention provides a hand-held sanding block suitable, for example, for woodworking. The sanding block includes separated raised abrasive surfaces on individual separated portions each of which can be compressed relatively independently, therefore making the sanding block particularly suited for sanding a profiled wooden surface, such as wood trim molding. The sanding block, however, may be used in a wide variety of end use applications including sanding flat surfaces and sanding painted surfaces.

In one aspect, the present invention provides a sanding block comprising a resilient body including a plurality of separated portions. The separated portions have raised end surfaces that define an abrasive working surface. An adhesive make coat is coated on the separated portion end surfaces, and abrasive particles having a hardness of at least 1200 Knoops are at least partially embedded in the adhesive make coat. In a specific aspect, the raised end surfaces are separated by recessed regions that are substantially free of adhesive make coat and/or abrasive particles.

In another aspect, the invention provides a hand-held abrasive article for abrading a surface comprising a resilient foam body having a density of at least 4 pounds per cubic foot, the body further including a plurality of separated portions, the separated portions having raised end surfaces defining an abrasive working surface. An adhesive make coat is coated on the separated portion end surfaces, and abrasive particles are at least partially embedded in the make coat.

In yet another aspect, the present invention provides a hand-held abrasive article for abrading a surface, the article comprising a unitary resilient body having a continuous block portion and a discontinuous active portion, the discontinuous active portion having a discontinuous abrasive surface defined by a plurality of discrete raised abrasive regions separated by recessed regions substantially free of adhesive make coat and/or abrasive particles.

In another aspect, the invention provides an abrasive article comprising a non abrasive resilient body including a plurality of separated portions and a separate abrasive member arranged adjacent the separated portions.

In another aspect, the present invention provides a method of making a hand-held abrasive article comprising the steps of providing a resilient body having an abrasive surface and removing material from the abrasive surface and the underlying resilient body to form non-abrasive recessed regions between the separated portions, thereby to form discrete separated portions having abrasive end surfaces.

In yet another aspect, the present invention provides a method of making a hand-held abrasive article comprising the steps of providing a resilient body, shaping the resilient body to include a plurality of raised regions and recessed regions, selectively coating the raised regions of the resilient body with an adhesive make coat without coating the recessed regions with the adhesive make coat, and depositing abrasive particles on the make coat.

BRIEF DESCRIPTION OF THE DRAWINGS

The present invention will be further described with reference to the accompanying drawings, in which.

DETAILED DESCRIPTION

Figure 1:
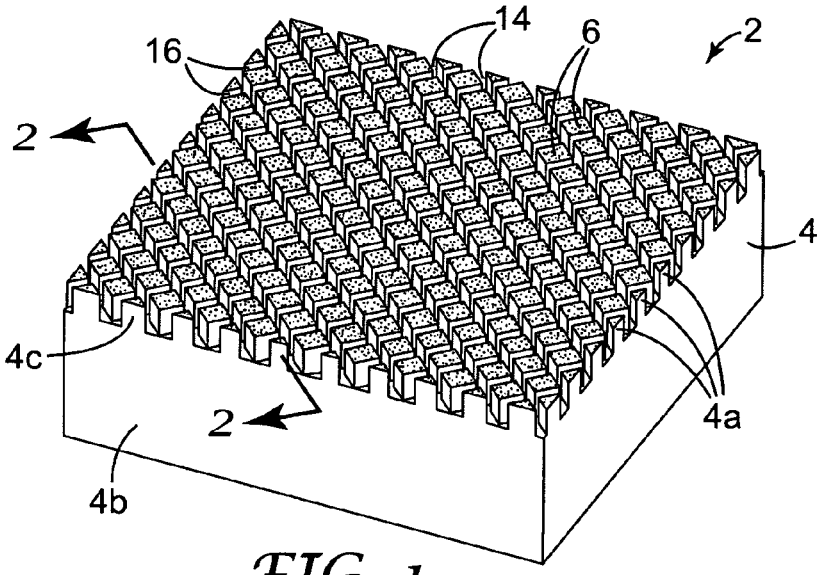
FIG. 1 is a perspective view of an abrasive article according to the invention.
Figure 2:
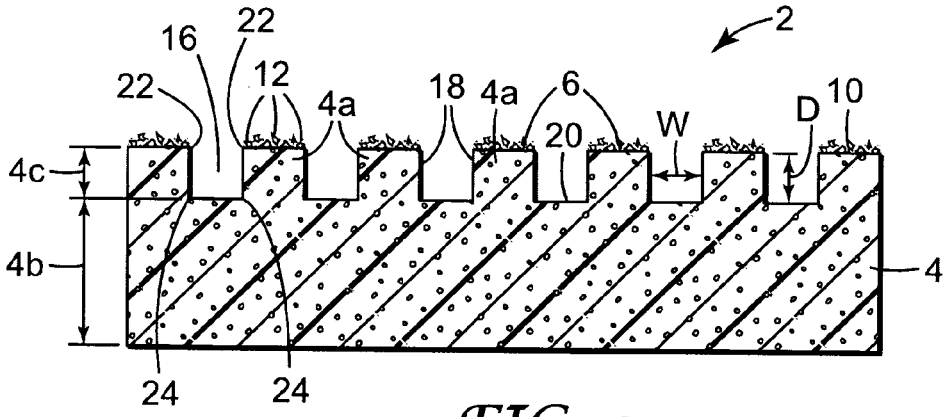
FIG. 2 is a sectional view taken along line 2—2 of FIG. 1.

Referring now to the drawings, FIGS. 1 and 2 show a hand-held resilient abrasive article 2 according to a first embodiment of the invention. The abrasive article 2 generally includes a resilient body 4 having a plurality of discrete separated portions 4*a* each having an abrasive end surface 6.

Providing the abrasive article 2 with a plurality of discrete separated portions 4*a*, each with an abrasive end surface 6, offers a number of advantages over conventional sanding sponges with a single flat surface. One advantage is that the abrasive article 2 is more effective at sanding contoured or profiled work surfaces, such as wood trim molding, because the separated portions 4*a* allow the article 2 to more readily conform to the contoured surface. That is, because the separated portions 4*a* form discrete separate portions that are not connected to adjacent portions, each separated portion 4*a* is able to be compressed generally independently, thereby improving the ability of the article 2 to conform to a contoured surface. This, in turn, enhances the ability of the article 2 to match the profile of the contoured surface. Another advantage of providing the article 2 with a plurality of individual separated portions 4*a* is that the separated portions 4*a* produce a rocking action or agitated movement during the sanding operation that improves the overall sanding performance of the article. Another advantage is that the article 2 may be bent or curved to form a generally smooth radius (i.e. without bunching or buckling), thereby greatly facilitating the sanding of curved surfaces such as the curved or "bull nose" surfaces that are commonly used, for example, on the edges of wooden stairs.

In the illustrated embodiment, the resilient body 4 is constructed from a single piece of resilient material, such as foam. To more easily understand the construction of the article 2, the unitary or one-piece resilient body 4 may be thought of as including a continuous block portion 4*b* and a discontinuous active portion 4*c*, which is formed by the separated portions 4*a*. The continuous block portion 4*b* allows a user to manually grasp the abrasive article 2 and also serves to interconnect the individual separated portions 4*a*. Each separated portion 4*a* extends outwardly from the block portion 4*b* and includes an exposed abrasive end surface 6 opposite the block portion 4*b*. In the illustrated embodiment, the abrasive end surfaces 6 of the separated portions 4*a* are generally planar. The topography of the end surfaces 6, however, may take a variety of forms such as an undulating, arched, pyramidal, or dome shaped surface.

An adhesive make coat 10 (FIG. 2) is coated on the end surface 6 of each separated portion 4*a*. In an exemplary embodiment, the make coat 10 is coated on the end surfaces 6 of the separated portions 4*a* and is generally not coated in the recessed region between the separated portions 4*a*. This may be accomplished, for example, by either coating a continuous surface of the resilient body 4 prior to forming the separated portions 4*a*, and then cutting or otherwise forming the resilient body 4 to form the separated portions (i.e. by removing a portion of the surface, the associated make coat and the resilient underlying resilient body in the region between the separated potions 4*a*), or by first forming the resilient body 4 with separated portions 4*a* and then coating the end surfaces 6 of the separated portions 4*a* without coating the recessed regions between the separated portions 4*a*.

One advantage of coating the make coat 10 on the resilient body 4 in this manner (i.e. on the end surfaces 6 of the separated portions 4*a* and not in the recessed regions between the separated portions 4*a*) is that the make coat 10 will not significantly interfere with the resiliency of the article 2. That is, because the make coat 10 tends to stiffen the resilient body 4 and therefore reduces the ability of the resilient body 4 to conform to a contoured surface, the make coat 10 is provided on the end surfaces 6 of the separated portion 4*a* to minimize this stiffening effect. It will be recognized, however, that the entire surface of the resilient body 4 including both the separated portions 4*a* and the recessed region between the separated portions 4*a* may be coated with make coat 10 even though this may reduce the overall resiliency of the body 4 somewhat. Suitable adhesive make coat materials are described separately below.

Abrasive particles 12 (FIG. 2) are embedded in the adhesive make coat 10. The abrasive coated end surfaces 6 of the separated portions 4*a* together define a abrasive working surface. In accordance with one aspect of the invention, the abrasive particles 12 are selected to allow the abrasive article 2 to be used to sand, abrade, or otherwise remove material from a work surface. That is, the abrasive particles are sufficiently hard to remove material from the surface itself, not just remove foreign material that is adhered to the surface being sanded. Stated another way, the abrasive particles are selected to scratch or "damage" the surface. This is in contrast to, for example, kitchen or bath cleaning, scrubbing, or polishing operations in which damage or scratching of the surface is undesirable and is to be avoided. Suitable abrasive particles typically have a hardness of at least about 1200 Knoops, more typically at least about 2000 Knoops, and even more typically at least about 2400 Knoops. Specific abrasive particles suitable for the abrasive article of the invention are described separately below.

In the illustrated embodiment, the separated portions 4*a* are separated by a gap or open space in the form of a first set of parallel elongated channels 14 and a second set of parallel elongated channels 16 arranged to form a rectilinear grid, thereby defining the plurality of individual discrete separated portions 4*a*. In the illustrated embodiment, each set of channels 14,16 is arranged diagonal to the sides of the resilient body 4. Arranged in this manner, when the abrasive article 2 is moved back and forth in any direction that is offset from the direction of the channels 14,16, such as in the direction of the ends or sides of the article 2, the entire surface being sanding will be contacted by abrasive, thereby ensuring complete sanding coverage. If, on the other hand, either set of channels 14,16 were arranged parallel to the ends or sides of the abrasive article 2 and the abrasive article were moved back and forth in a direction parallel to the channels, areas of the surface being sanded that are aligned with the channels may not be sanded, depending on the width of the channels and the contour of the surface being sanded. Stated another way, if the abrasive end surfaces 6 are aligned with the direction of sanding, and the channels 14 or 16—which are generally free of abrasive—are also aligned with the direction of sanding, the surface being sanded will be sanded only in the areas aligned with the abrasive end surfaces 6 and may not be sanded in the areas aligned with the abrasive free channels 14,16.

To allow the individual separated portions 4*a* adequate space to deform, compress, or otherwise move to conform to a surface during the sanding operation, the channels 14,16 typically have a width W (FIG. 2) of at least about 1 mm, more typically at least 2 mm, and even more typically at least 3 mm. In addition, the channels 14,16 typically have a depth "D" of at least about 2 mm, more typically at least about 5 mm, and even more typically at least about 7 mm.

In the illustrated embodiment, the channels 14, 16 have generally parallel side surfaces 18 that are perpendicular to the end surfaces 6, and a generally planar bottom surface 20 that is perpendicular to the side surfaces 18. In this manner, the channels 14, 16 have a generally square or rectangular cross section, thereby creating separated portions 4*a* in the form of columns. The channels 14,16 may have other cross-sectional shapes such as V-shaped or U-shaped cross sections. In addition, the raised portions 4*a* themselves may take a variety of forms including parallel-piped columns, cylindrical columns, domes, pyramids, frusto pyramidal, conical, or frusto conical shapes.

Figure 3:
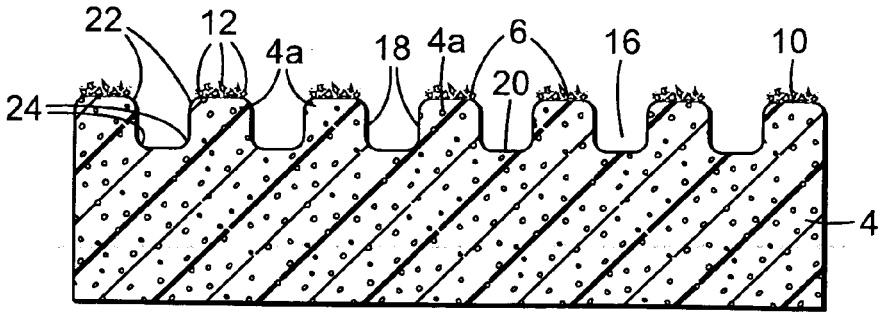
FIG. 3 is a sectional view of a second embodiment of the invention.

FIG. 3 shows a second embodiment of the invention similar to the embodiment shown in FIGS. 1 and 2 except the relatively sharp outside corner edges 22 in the regions adjoining the end surface 6 of the separated portions 4*a* and the side surfaces 18 of the channels 14,16 and the relatively sharp inside corners 24 in the regions adjoining the side surfaces 18 of the channels 14,16 and the bottom surface 20 of the channels are curved or rounded. The end surface 6 itself as well as the bottom surface 20 of the channels 14,16, however, still include generally planar central regions. It has been found that the relatively sharp outside corner edges 22 have a tendency to catch or snag on rough surfaces, and the relatively sharp inside corners 24 serve as stress concentration points. Thus, when the ends of the separated portions 4*a* snag on a rough surface, the separated portions 4*a* may tear along inside corners 24. By rounding the outside corner edges 22, the separated portions 4*a* have a reduced likelihood of catching or snagging, thereby reducing the likelihood of tearing. And by rounding the inside corners 24, the stress concentration points are minimized, thereby strengthening the region where the separated portions 4*a* are connected with the block portion 4*b* and further reducing the likelihood that the resilient body 4 will tear in the event of a snag. In this manner, the overall durability of the resilient body 4 is significantly improved.

Figure 4:
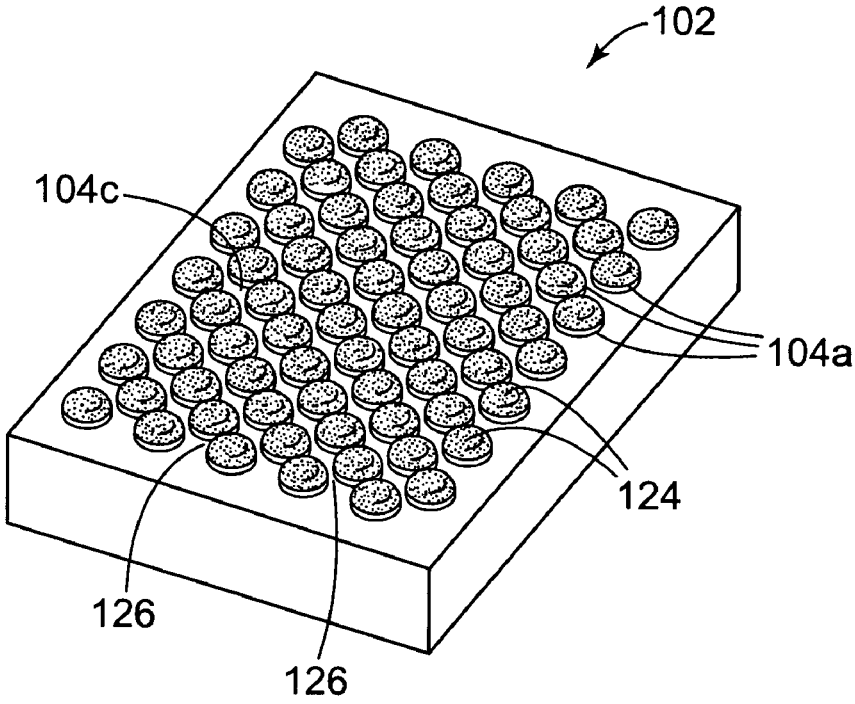
FIG. 4 is a perspective view of a third embodiment of the invention.

Throughout the remaining description and the accompanying figures, functionally similar features are referred to with like reference numerals incremented by 100. FIG. 4 shows a resilient abrasive article 102 having an active portion 104*c* including a plurality of separated portions 104*a* including circular domes, knobs, or rounded bumps 124. The bumps 124 are arranged in a non-random pattern with diagonally arranged longitudinally extending recessed regions or valleys 126 separating adjacent bumps. Because of the geometry of the active portion 104*c* of the article 102, a particularly suitable method for producing the structured topography of the active portion 104*c* is by forming a heat moldable foam material using a heat molding die. One advantage of using a heat moldable foam material and a heated die is that during the molding process, the foam material melts and forms a durable outer layer or skin on the article.

Figure 5:
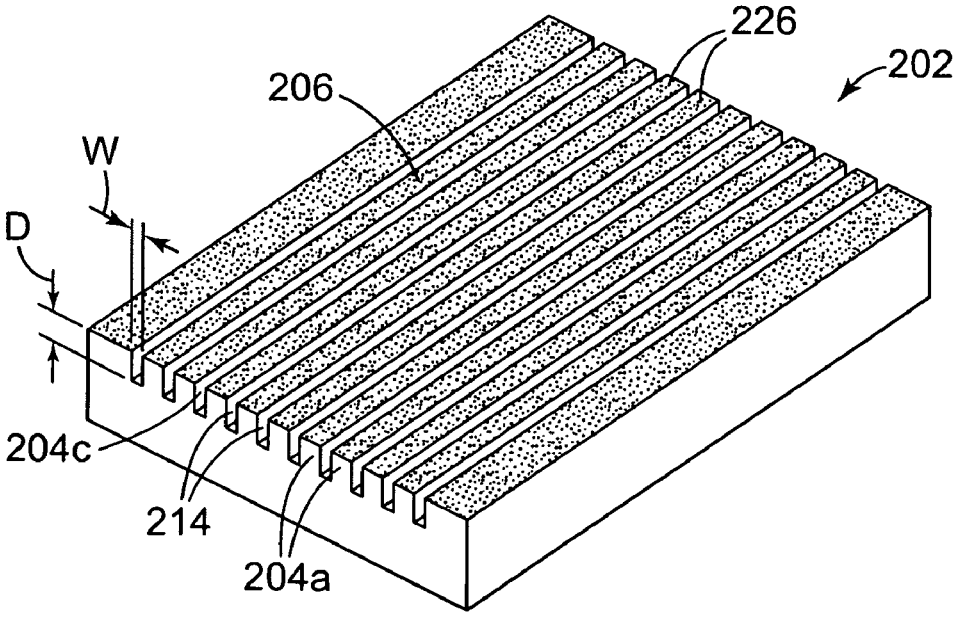
FIG. 5 is a perspective view of a fourth embodiment of the invention.

FIG. 5 shows a resilient abrasive article 202 having an active portion 204*c* including a plurality of separated portions 204*a* in the form of parallel longitudinally extending ridges 226 separated by generally parallel longitudinally extending channels 214. It will be recognized that while the ridges 226 are illustrated as having generally planar top surfaces 206, the top surfaces 206 may have a variety of surface textures and shapes including undulating, dimpled, arched, and inverted V shapes. In addition, it will be recognized that the active portion 204*c* may further include transverse channels (not shown) arranged either diagonally or at a 90 degree angle to the longitudinally extending channels 214.

In the illustrated embodiment, the channels 214 have a generally square or rectangular cross section, thereby creating separated portions 204*a* in the form of columns; however, the channels may have other cross-sectional shapes such as V-shaped or U-shaped cross sections as described with respect to previously described embodiments. The channels 214 typically have a width W of at least about 1 mm, more typically at least 2 mm, and even more typically at least 3 mm. The channels 214 typically have a depth "D" of at least about 2 mm, more typically at least about 5 mm, and even more typically at least about 7 mm.

Figure 6:
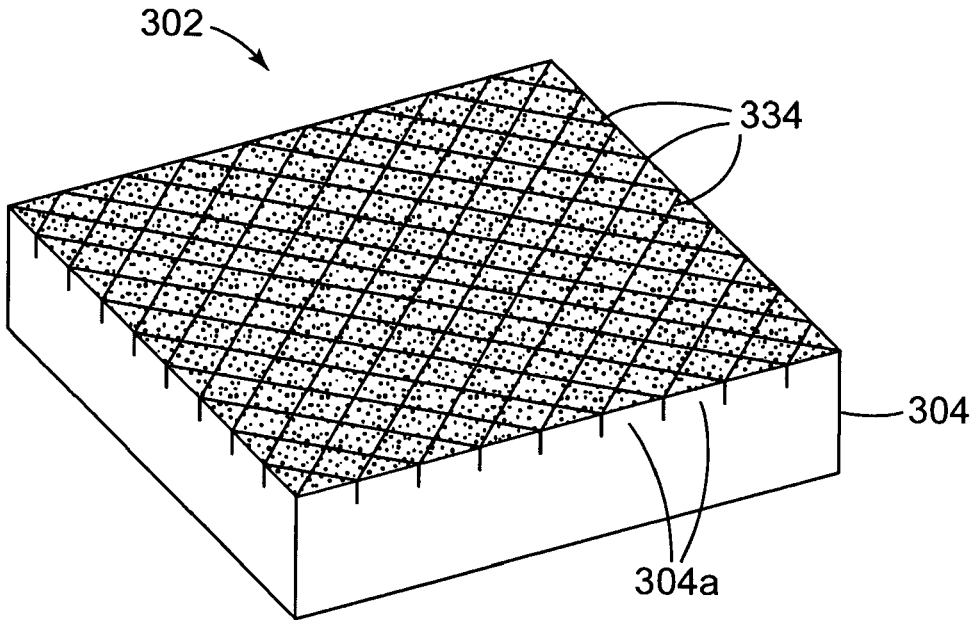
FIG. 6 is a perspective view of a fifth embodiment of the invention.

FIG. 6 shows a resilient abrasive article 302 similar to the abrasive article of FIGS. 1 and 2 except the separated regions 304*a* are defined by a grid of generally parallel diagonally arranged narrow cuts or slits 334 extending from one side of the resilient body 304 to another side. Formed in this manner, the separated regions 304*a* are arranged in abutting relation yet are permitted to compress or move generally independently relative to adjacent separated regions. The slits 334 typically have a depth of at least about 2 mm, more typically at least about 5 mm, and even more typically at least about 7 mm.

Figure 7:
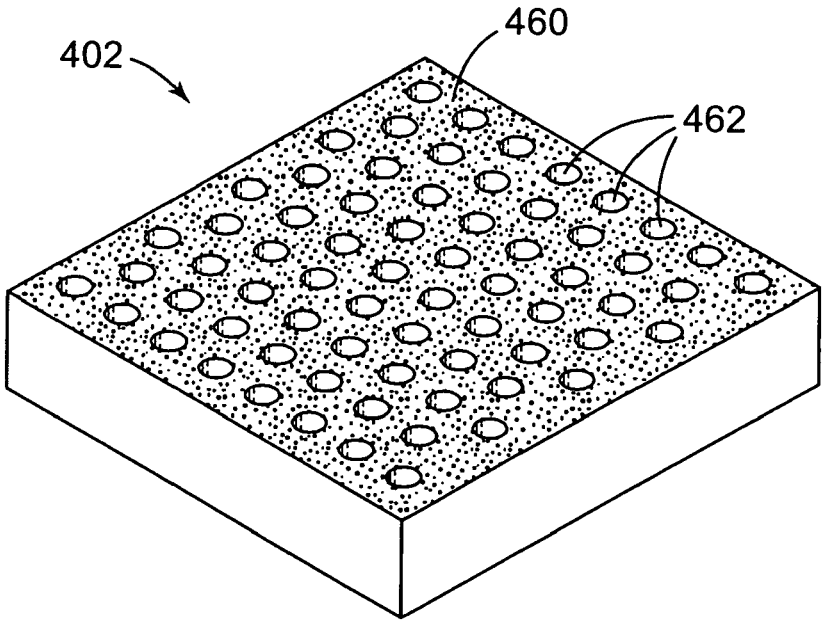
FIG. 7 is a perspective view of a sixth embodiment of the invention.

FIG. 7 shows a resilient abrasive article 402 in which the raised region is a continuously interconnected abrasive surface 460 and the recessed region comprises a plurality of discrete abrasive free holes 462 that are surrounded by the abrasive surface 460. Although the continuously interconnected abrasive surface 460 does not provide the same degree of conformability to contoured surfaces as the discrete separated portions 4*a*, 104*a* of FIGS. 1–5, or the longitudinally extending ridges 226 of FIG. 5, the ability of the abrasive surface 460 to conform to a contoured surface is enhanced by some degree by the holes 462. Although the holes 462 are shown as being circular, the holes may come in a variety of sizes and shapes, and in a variety of patterns, to further improve the conformability of the article.

Figure 8:
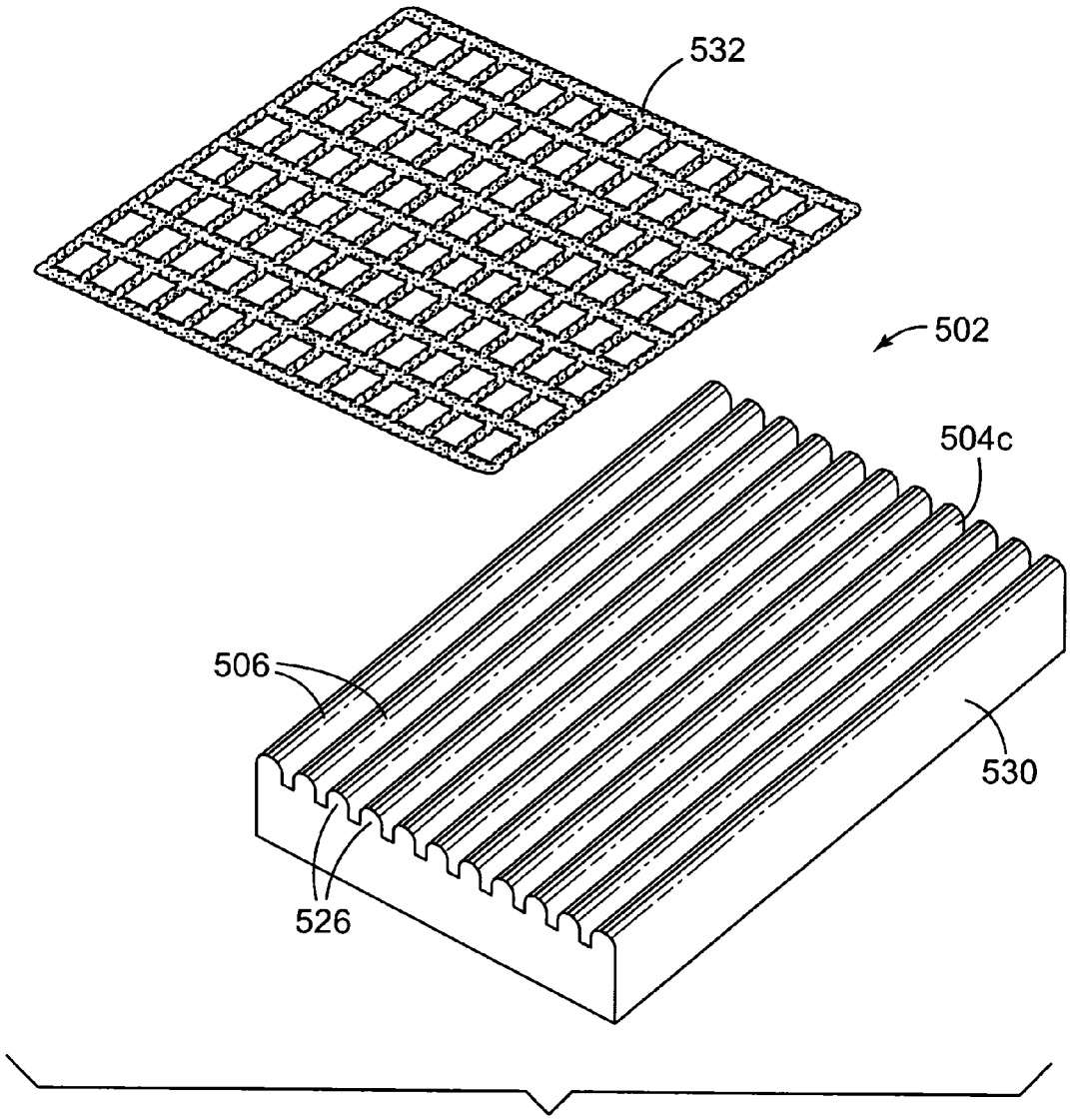
FIG. 8 is a perspective view of a seventh embodiment of the invention.

FIG. 8 shows a resilient abrasive article 502 comprising a structured resilient member 530 that does not itself include an abrasive surface. In the illustrated embodiment, the article 502 has an active portion 504*c* including a plurality of parallel elongated ridges 526 with rounded end surfaces 506, and a separate conformable abrasive member 532 arranged adjacent the active portion 504*c* of the abrasive article. The resilient member 530 could also have a structure similar to the resilient bodies shown in FIGS. 1, 3, and 4–7.

A suitable abrasive member 532 is described in U.S. Pat. No. 6,613,113, the contents of which are hereby incorporated by reference. The abrasive member described therein comprises a flexible sheet substrate comprising a multiplicity of separated resilient bodies connected to each other in a generally planar array in a pattern which provides open spaces between adjacent connected bodies, each body having a first surface and an opposite second surface. Other conformable abrasive sheets, however, may also be used.

By providing a resilient member 530 having an active portion 504*c* that is not coated with abrasive and a separate abrasive member 532, the resilient member 530 may be reused when the abrasive member 532 loses it effectiveness by simply replacing the abrasive member 532 with a new abrasive member rather than disposing of the entire abrasive article 502, thereby reducing waste.

The abrasive member 532 may be manually retained against the active portion 504*c* of the resilient member 530 by a user simply grasping and holding the resilient member 530 and abrasive member 532 together. Alternatively, the members 530, 532 may be removably attached using a suitable mechanical attachment system, such as hook and loop attachment means, or by adhesive attachment.

In general, the resilient body in the various embodiments of the invention is sized to fit comfortably in a user's hand. Accordingly, the resilient body typically has a width of at least 2 inches (50 mm) and a length of at least 3 inches (76 mm). In addition, the invention typically has an overall thickness of at least about 5 mm, more typically at least about 10 mm, and even more typically at least about 20 mm.

The thickness of the resilient body is important for at least two reasons. First, sufficient thickness allows a user to readily grasp the abrasive article. In addition, the thickness serves, at least in part, to distribute the sanding force applied by a user more evenly to the abrasive surface of the article, thereby providing more uniform sanding pressure. That is, if a force is applied to a specific region of a relatively thin resilient body, the force will be transmitted through the resilient body to a specific region of the abrasive surface. This may result in concentrated and uneven sanding. Distribution of the applied force also depends on the density of the resilient body itself. Thus, for a resilient body formed of foam, the foam typically has a density of at least about 2 pounds per cubic foot (pcf), more typically at least about 4 pcf, and even more typically, at least about 6 pcf. Suitable materials for the resilient body are described separately below.

In addition, the separated portions in any of the embodiments generally have a height of at least about 4 mm, more generally at least about 6 mm, and, in a some embodiments, at least about 9 mm.

Figure 9:
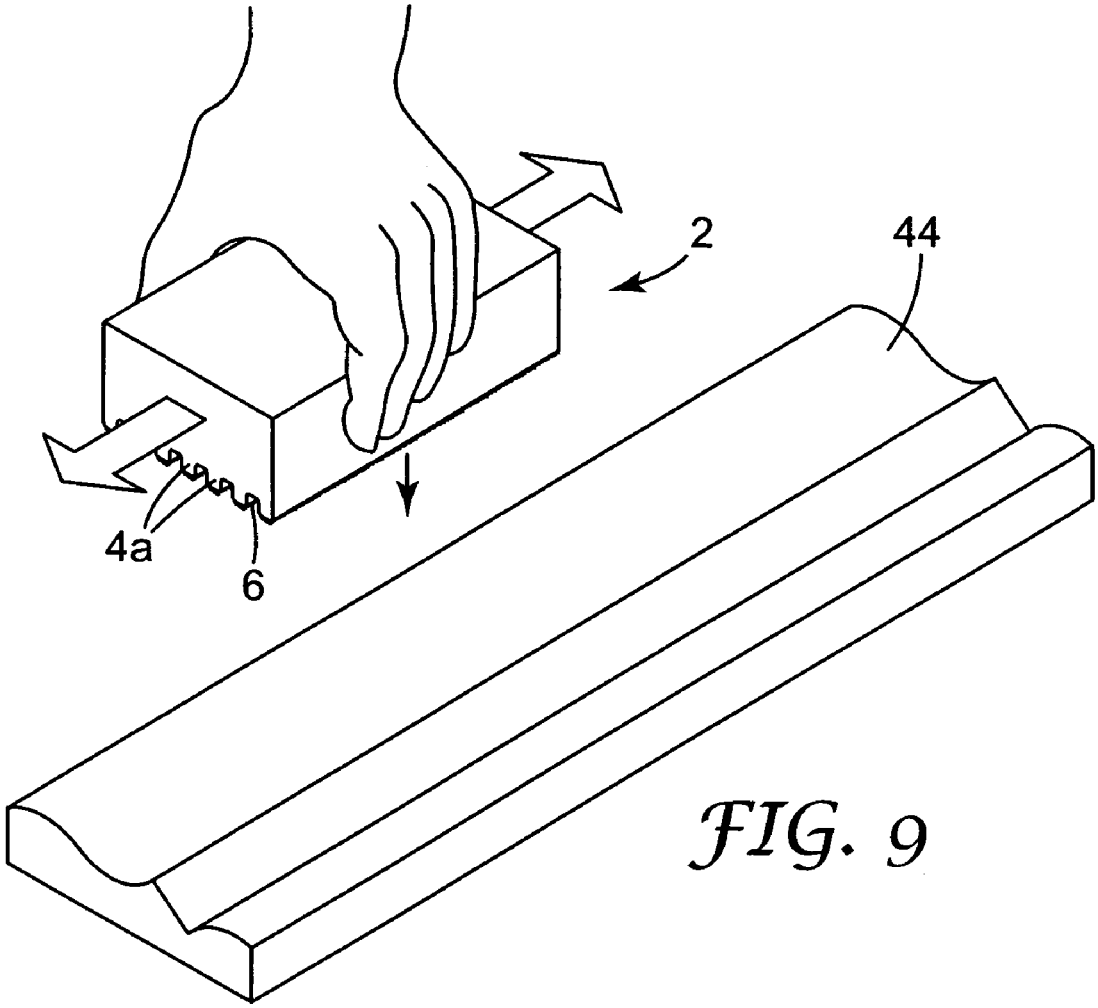
FIG. 9 is a perspective view illustrating the use of the article of FIG. 1.

FIG. 9 generally demonstrates the method of using the abrasive articles according to the various embodiments of the invention described above to sand a contoured work surface 44 such as wood trim molding. The abrasive article 2 is first manually grasped and held firmly by a user so that the abrasive end surfaces 6 face the work surface 44 to be sanded. The abrasive article 2 is then pressed against the work surface 44 until the separated portions 4*a* substantially conform to the contoured surface 44. Because the separated portions 4*a* can deform independently relative to adjacent separated portions 4*a*, the abrasive end surfaces 6 can more readily match the uneven or irregular profile of the work surface, thereby providing more thorough surface coverage of the surface 44. To complete the sanding operation, the abrasive article 2 is moved back and forth along the work surface 44 while maintaining sufficient pressure against the work surface 44 until the desired amount of material has been removed from the work surface 44. It will be recognized that to remove material from the work surface 44, the abrasive particles have a hardness that is greater than the hardness of the work surface being sanded.

Other aspects of the invention that are applicable to the various embodiments described above are described in more detail below.

Material of the Body

In general, any resilient or conformable material with at least one coatable surface may be used for the body of the sanding article. These materials include open-cell foam, closed-cell foam, and reticulated foam, each of which can further include a durable outer skin layer. Suitable foam materials can be made from synthetic polymer materials, such as, polyurethanes, foam rubbers, and silicones, and natural sponge materials. The thickness of the foam body is only limited by the desired end use of the abrasive article. Preferred bodies have a thickness in the range of about 1 mm to about 50 mm, although bodies having a greater thickness can also be used.

Make Coat

In general, any make coat adhesive material may be used to adhere the abrasive particles to the resilient body. The make coat is typically formed by applying a make coat precursor to the body. "Make coat precursor" refers to the coatable resinous adhesive material applied to the body of the abrasive article, thereby serving to secure abrasive particles to the body. "Make coat" refers to the layer of hardened resin over the body of the abrasive article formed by hardening the make coat precursor.

In certain embodiments, the thickness of the make coat adhesive is adjusted so that at least about 10%, 20%, or 30% but no greater than about 35%, 40% or 45% of the individual grain length protrudes above the cured make adhesive layer. Generally, larger grit minerals (smaller grit numbers) require more make adhesive than smaller grit minerals (larger grit numbers).

The make coat precursor is generally applied to the body of the article at a coating weight which, when cured, provides the necessary adhesion to securely bond the abrasive particles to the coatable surfaces of the body. For typical make coats, the dry add-on weight of the make coat will range from about 1 to 20 grains/24 $in^2$ (4.2–84 $g/m^2$). In certain embodiments, the make coat dry add-on weight will have a lower limit of 2 grains/24 $in^2$ (8.4 $g/m^2$), 4 grains/24 $in^2$ (16.8 $g/m^2$), or 6 grains/24 $in^2$ (25.2 $g/m^2$), and will have an upper limit of 8 grains/24 $in^2$ (33.6 $g/m^2$), 10 grains/24 $in^2$ (42 $g/m^2$), or 12 grains/24 $in^2$ (50.4 $g/m^2$).

The make coat layer preferably comprises organic precursor polymer subunits. The precursor polymer subunits preferably are capable of flowing sufficiently so as to be able to coat a surface. Solidification of the precursor polymer subunits may be achieved by curing (e.g., polymerization and/or cross-linking), by drying (e.g., driving off a liquid) and/or simply by cooling. The precursor polymer subunits may be an organic solvent borne, a water-borne, or a 100% solids (i.e., a substantially solvent-free) composition. Both thermoplastic and/or thermosetting polymers, or materials, as well as combinations thereof, may be used as precursor polymer subunits. Upon the curing, drying or cooling of the precursor polymer subunits, the composition forms the make coat. The preferred precursor polymer subunits can be either a condensation curable resin or an addition polymerizable resin. The addition polymerizable resins can be ethylenically unsaturated monomers and/or oligomers. Examples of useable crosslinkable materials include phenolic resins, bismaleimide binders, vinyl ether resins, aminoplast resins having pendant alpha, beta unsaturated carbonyl groups, urethane resins, epoxy resins, acrylate resins, acrylated isocyanurate resins, urea-formaldehyde resins, isocyanurate resins, acrylated urethane resins, acrylated epoxy resins, or mixtures thereof.

The precursor polymer subunits are preferably a curable organic material (i.e., a polymer subunit or material capable of polymerizing and/or crosslinking upon exposure to heat and/or other sources of energy, such as electron beam, ultraviolet light, visible light, etc., or with time upon the addition of a chemical catalyst, moisture, or other agent which cause the polymer to cure or polymerize). Precursor polymer subunits examples include amino polymers or aminoplast polymers such as alkylated urea-formaldehyde polymers, melamine-formaldehyde polymers, and alkylated benzoguanamine-formaldehyde polymer, acrylate polymers including acrylates and methacrylates alkyl acrylates, acrylated epoxies, acrylated urethanes, acrylated polyesters, acrylated polyethers, vinyl ethers, acrylated oils, and acrylated silicones, alkyd polymers such as urethane alkyd polymers, polyester polymers, reactive urethane polymers, phenolic polymers such as resole and novolac polymers, phenolic/latex polymers, epoxy polymers such as bisphenol epoxy polymers, polyol modified epoxy polymers, isocyanates, isocyanurates, polysiloxane polymers including alkylalkoxysilane polymers, or reactive vinyl polymers. The resulting binder may be in the form of monomers, oligomers, polymers, or combinations thereof.

The aminoplast precursor polymer subunits have at least one pendant alpha, beta-unsaturated carbonyl group per molecule or oligomer. These polymer materials are further described in U.S. Pat. No. 4,903,440 (Larson et al.) and U.S. Pat. No. 5,236,472 (Kirk et al.), both incorporated herein by reference.

Preferred cured abrasive coatings are generated from free radical curable precursor polymer subunits. These precursor polymer subunits are capable of polymerizing rapidly upon an exposure to thermal energy and/or radiation energy. One preferred subset of free radical curable precursor polymer subunits include ethylenically unsaturated precursor polymer subunits. Examples of such ethylenically unsaturated precursor polymer subunits include aminoplast monomers or oligomers having pendant alpha, beta unsaturated carbonyl groups, ethylenically unsaturated monomers or oligomers, acrylated isocyanurate monomers, acrylated urethane oligomers, acrylated epoxy monomers or oligomers, ethylenically unsaturated monomers or diluents, acrylate dispersions, and mixtures thereof. The term acrylate includes both acrylates and methacrylates.

Ethylenically unsaturated precursor polymer subunits include both monomeric and polymeric compounds that contain atoms of carbon, hydrogen and oxygen, and optionally, nitrogen and the halogens. Oxygen or nitrogen atoms or both are generally present in the form of ether, ester, urethane, amide, and urea groups. The ethylenically unsaturated monomers may be monofunctional, difunctional, trifunctional, tetrafunctional or even higher functionality, and include both acrylate and methacrylate-based monomers. Suitable ethylenically unsaturated compounds are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, or maleic acid. Representative examples of ethylenically unsaturated monomers include methyl methacrylate, ethyl methacrylate, styrene, divinylbenzene, hydroxyethyl acrylate, hydroxyethyl methacrylate, hydroxypropyl acrylate, hydroxy propyl methacrylate, hydroxybutyl acrylate, hydroxybutyl methacrylate, lauryl acrylate, octyl acrylate, caprolactone acrylate, caprolactone methacrylate, tetrahydrofurfuryl methacrylate, cyclohexyl acrylate, stearyl acrylate, 2-phenoxyethyl acrylate, isooctyl acrylate, isobornyl acrylate, isodecyl acrylate, polyethylene glycol monoacrylate, polypropylene glycol monoacrylate, vinyl toluene, ethylene glycol diacrylate, polyethylene glycol diacrylate, ethylene glycol dimethacrylate, hexanediol diacrylate, triethylene glycol diacrylate, 2-(2-ethoxyethoxy) ethyl acrylate, propoxylated trimethylol propane triacrylate, trimethylolpropane triacrylate, glycerol triacrylate, pentaerthyitol triacrylate, pentaerythritol trimethacrylate, pentaerythritol tetraacrylate and pentaerythritol tetramethacrylate. Other ethylenically unsaturated materials include monoallyl, polyallyl, or polymethallyl esters and amides of carboxylic acids, such as diallyl phthalate, diallyl adipate, or N,N-diallyladipamide. Still other nitrogen containing ethylenically unsaturated monomers include tris(2-acryloxyethyl)isocyanurate, 1,3,5-tri(2-methyacryloxyethyl)-s-triazine, acrylamide, methylacrylamide, N-methyl-acrylamide, N,N-dimethylacrylamide, N-vinylpyrrolidone, or N-vinylpiperidone.

A preferred precursor polymer subunit contains a blend of two or more acrylate monomers. For example, the precursor polymer subunits may be a blend of trifunctional acrylate and a monofunctional acrylate monomers. An example of one precursor polymer subunits is a blend of propoxylated trimethylol propane triacrylate and 2-(2-ethoxyethoxy) ethyl acrylate.

It is also feasible to formulate a precursor polymer subunits from a mixture of an acrylate and an epoxy polymer, e.g., as described in U.S. Pat. No. 4,751,138 (Tumey et al.), incorporated herein by reference.

Other precursor polymer subunits include isocyanurate derivatives having at least one pendant acrylate group and isocyanate derivatives having at least one pendant acrylate group are further described in U.S. Pat. No. 4,652,274 (Boettcher et al.), incorporated herein by reference. The preferred isocyanurate material is a triacrylate of tris(hydroxyethyl) isocyanurate.

Still other precursor polymer subunits include diacrylate urethane esters as well as polyacrylate or poly methacrylate urethane esters of hydroxy terminated isocyanate extended polyesters or polyethers. Examples of commercially available acrylated urethanes include those under the trade name "UVITHANE 782," available from Morton Chemical, Moss Point, Miss.; "CMD 6600," "CMD 8400," and "CMD 8805," available from UCB Radcure Specialties, Smyrna, Ga.; "PHOTOMER" resins (e.g., PHOTOMER 6010) from Henkel Corp., Hoboken, N.J.; "EBECRYL 220" (hexafunctional aromatic urethane acrylate), "EBECRYL 284" (aliphatic urethane diacrylate of 1200 diluted with 1,6-hexanediol diacrylate), "EBECRYL 4827" (aromatic urethane diacrylate), "EBECRYL 4830" (aliphatic urethane diacrylate diluted with tetraethylene glycol diacrylate), "EBECRYL 6602" (trifunctional aromatic urethane acrylate diluted with trimethylolpropane ethoxy triacrylate), "EBECRYL 840" (aliphatic urethane diacrylate), and "EBECRYL 8402" (aliphatic urethane diacrylate) from UCB Radcure Specialties; and "SARTOMER" resins (e.g., "SARTOMER" 9635, 9645, 9655, 963-B80, 966-A80, CN980M50, etc.) from Sartomer Co., Exton, Pa.

Yet other precursor polymer subunits include diacrylate epoxy esters as well as polyacrylate or polymethacrylate epoxy ester such as the diacrylate esters of bisphenol A epoxy polymer. Examples of commercially available acrylated epoxies include those under the trade name "CMD 3500," "CMD 3600," and "CMD 3700," available from UCB Radcure Specialties.

Other precursor polymer subunits may also be acrylated polyester polymers. Acrylated polyesters are the reaction products of acrylic acid with a dibasic acid/aliphatic diol-based polyester. Examples of commercially available acrylated polyesters include those known by the trade designations "PHOTOMER 5007" (hexafunctional acrylate), and "PHOTOMER 5018" (tetrafunctional tetracrylate) from Henkel Corp.; and "EBECRYL 80" (tetrafunctional modified polyester acrylate), "EBECRYL 450" (fatty acid modified polyester hexaacrylate) and "EBECRYL 830" (hexafunctional polyester acrylate) from UCB Radcure Specialties.

Another preferred precursor polymer subunits is a blend of ethylenically unsaturated oligomer and monomers. For example the precursor polymer subunits may comprise a blend of an acrylate functional urethane oligomer and one or more monofunctional acrylate monomers. This acrylate monomer may be a pentafunctional acrylate, tetrafunctional acrylate, trifunctional acrylate, difunctional acrylate, monofunctional acrylate polymer, or combinations thereof.

The precursor polymer subunits may also be an acrylate dispersion like that described in U.S. Pat. No. 5,378,252 (Follensbee), incorporated herein by reference.

In addition to thermosetting polymers, thermoplastic binders may also be used. Examples of suitable thermoplastic polymers include polyamides, polyethylene, polypropylene, polyesters, polyurethanes, polyetherimide, polysulfone, polystyrene, acrylonitrile-butadiene-styrene block copolymer, styrene-butadiene-styrene block copolymers, styrene-isoprene-styrene block copolymers, acetal polymers, polyvinyl chloride and combinations thereof.

Water-soluble precursor polymer subunits optionally blended with a thermosetting resin may be used. Examples of water-soluble precursor polymer subunits include polyvinyl alcohol, hide glue, or water-soluble cellulose ethers such as hydroxypropylmethyl cellulose, methyl cellulose or hydroxyethylmethyl cellulose. These binders are reported in U.S. Pat. No. 4,255,164 (Butkze et al.), incorporated herein by reference.

In the case of precursor polymer subunits containing ethylenically unsaturated monomers and oligomers, polymerization initiators may be used. Examples include organic peroxides, azo compounds, quinones, nitroso compounds, acyl halides, hydrazones, mercapto compounds, pyrylium compounds, imidazoles, chlorotriazines, benzoin, benzoin alkyl ethers, diketones, phenones, or mixtures thereof. Examples of suitable commercially available, ultraviolet-activated photoinitiators have trade names such as "IRGACURE 651," "IRGACURE 184," and "DAROCUR 1173" commercially available from Ciba Specialty Chemicals, Tarrytown, N.Y. Another visible light-activated photoinitiator has the trade name "IRGACURE 369" commercially available from Ciba Geigy Company. Examples of suitable visible light-activated initiators are reported in U.S. Pat. No. 4,735,632 (Oxman et al.) and U.S. Pat. No. 5,674,122 (Krech et al.)

A suitable initiator system may include a photosensitizer. Representative photosensitizers may have carbonyl groups or tertiary amino groups or mixtures thereof. Preferred photosensitizers having carbonyl groups are benzophenone, acetophenone, benzil, benzaldehyde, o-chlorobenzaldehyde, xanthone, thioxanthone, 9,10-anthraquinone, or other aromatic ketones. Preferred photosensitizers having tertiary amines are methyldiethanolamine, ethyldiethanolamine, triethanolamine, phenylmethyl-ethanolamine, or dimethylaminoethylbenzoate. Commercially available photosensitizers include "QUANTICURE ITX," "QUANTICURE QTX," "QUANTICURE PTX," "QUANTICURE EPD" from Biddle Sawyer Corp.

In general, the amount of photosensitizer or photoinitiator system may vary from about 0.01 to 10% by weight, more preferably from 0.25 to 4.0% by weight of the components of the precursor polymer subunits.

Additionally, it is preferred to disperse (preferably uniformly) the initiator in the precursor polymer subunits before addition of any particulate material, such as the abrasive particles and/or filler particles.

In general, it is preferred that the precursor polymer subunits be exposed to radiation energy, preferably ultraviolet light or visible light, to cure or polymerize the precursor polymer subunits. In some instances, certain abrasive particles and/or certain additives will absorb ultraviolet and visible light, which may hinder proper cure of the precursor polymer subunits. This occurs, for example, with ceria abrasive particles. The use of phosphate containing photoinitiators, in particular acylphosphine oxide containing photoinitiators, may minimize this problem. An example of such an acylphosphate oxide is 2,4,6-trimethylbenzoyldiphenylphosphine oxide, which is commercially available from BASF Corporation, Ludwigshafen, Germany, under the trade designation "LUCIRIN TPO-L." Other examples of commercially available acylphosphine oxides include "DAROCUR 4263" and "DAROCUR 4265" commercially available from Ciba Specialty Chemicals.

Cationic initiators may be used to initiate polymerization when the binder is based upon an epoxy or vinyl ether. Examples of cationic initiators include salts of onium cations, such as arylsulfonium salts, as well as organometallic salts such as ion arene systems. Other examples are reported in U.S. Pat. No. 4,751,138 (Tumey et al.); U.S. Pat. No. 5,256,170 (Harmer et al.); U.S. Pat. No. 4,985,340 (Palazzotto) and U.S. Pat. No. 4,950,696, all incorporated herein by reference.

Dual-cure and hybrid-cure photoinitiator systems may also be used. In dual-cure photoiniator systems, curing or polymerization occurs in two separate stages, via either the same or different reaction mechanisms. In hybrid-cure photoinitiator systems, two curing mechanisms occur at the same time upon exposure to ultraviolet/visible or electron-beam radiation.

The make coat is applied to at least one side of the article and may be applied to any number of surfaces. The make coat binder precursor can be coated by any conventional technique, such as knife coating, spray coating, roll coating, rotogravure coating, curtain coating, and the like. The abrasive coating is typically applied to the surfaces coated with make coat. If applied to two surfaces, the abrasive particle size may be the same for each side or may be different for each side.

Abrasive Particles

The abrasive particles suitable for this invention include fused aluminum oxide, heat treated aluminum oxide, alumina-based ceramics, silicon carbide, zirconia, alumina-zirconia, garnet, diamond, ceria, cubic boron nitride, ground glass, quartz, titanium diboride, sol gel abrasives and combinations thereof. Examples of sol gel abrasive particles can be found in U.S. Pat. No. 4,314,827 (Leitheiser et al.); U.S. Pat. No. 4,623,364 (Cottringer et al); U.S. Pat. No. 4,744,802 (Schwabel); U.S. Pat. No. 4,770,671 (Monroe et al.) and U.S. Pat. No. 4,881,951 (Wood et al.), all incorporated herein after by reference. The abrasive particles can be either shaped (e.g., rod, triangle, or pyramid) or unshaped (i.e., irregular). The term "abrasive particle" encompasses abrasive grains, agglomerates, or multi-grain abrasive granules. Examples of such agglomerates are described in U.S. Pat. No. 4,652,275 (Bloecher, et al.) and U.S. Pat. No. 5,975,988 (Christianson) and assigned to the assignee of the present invention, each being incorporated herein by reference. The agglomerates can be irregularly shaped or have a precise shape associated with them, for example, a cube, pyramid, truncated pyramid, or a sphere. An agglomerate comprises abrasive particles or grains and a bonding agent. The bonding agent can be organic or inorganic. Examples of organic binders include phenolic resins, urea-formaldehyde resins, and epoxy resins. Examples of inorganic binders include metals (such as nickel), and metal oxides. Metal oxides are usually classified as either a glass (vitrified), ceramic (crystalline), or glass-ceramic. Further information on ceramic agglomerates is disclosed in U.S. Pat. No. 5,975,988 (Christianson) assigned to the assignee of the present invention.

Useful aluminum oxide grains for applications of the present invention include fused aluminum oxides, heat treated aluminum oxides, and ceramic aluminum oxides. Examples of such ceramic aluminum oxides are disclosed in U.S. Pat. No. 4,314,827 (Leitheiser, et al.), U.S. Pat. No. 4,744,802 (Schwabel), U.S. Pat. No. 4,770,671 (Monroe, et al.), and U.S. Pat. No. 4,881,951 (Wood, et al.).

Abrasive particles can be coated with materials to provide the particles with desired characteristics. For example, materials applied to the surface of an abrasive particle have been shown to improve the adhesion between the abrasive particle and the polymer. Additionally, a material applied to the surface of an abrasive particle may improve the dispersibility of the abrasive particles in the precursor polymer subunits. Alternatively, surface coatings can alter and improve the cutting characteristics of the resulting abrasive particle. Such surface coatings are described, for example, in U.S. Pat. No. 5,011,508 (Wald et al.); U.S. Pat. No. 3,041,156 (Rowse et al.); U.S. Pat. No. 5,009,675 (Kunz et al.); U.S. Pat. No. 4,997,461 (Markhoff-Matheny et al.); U.S. Pat. No. 5,213,951 (Celikkaya et al.); U.S. Pat. No. 5,085,671 (Martin et al.) and U.S. Pat. No. 5,042,991 (Kunz et al.), the disclosures of which are incorporated herein by reference.

The average particle size of the abrasive particle for advantageous applications of the present invention is at least about 0.1 micrometer, preferably at least about 65 micrometers. A particle size of about 100 micrometers corresponds approximately to a coated abrasive grade 150 abrasive grain, according to American National Standards Institute (ANSI) Standard B74.18-1984. The abrasive grain can be oriented, or it can be applied to the surface of the abrasive article without orientation, depending upon the desired end use of the abrasive article.

The abrasive particles can be embedded into the make coat precursor by any conventional technique such as electrostatic coating or drop coating. During electrostatic coating, electrostatic charges are applied to the abrasive particles and this propels the abrasive particles upward. Electrostatic coating tends to orient the abrasive particle, which generally leads to better abrading performance. In drop coating, the abrasive particles are forced from a feed station and fall into the binder precursor by gravity. It is also within the scope of this invention to propel the abrasive particles upward by a mechanical force into the binder precursor.

Additives

The make coat precursor or the size coat precursor or both can contain optional additives, such as fillers, fibers, lubricants, grinding aids, wetting agents, thickening agents, anti-loading agents, surfactants, pigments, dyes, coupling agents, photoinitiators, plasticizers, suspending agents, antistatic agents, and the like. Possible fillers include calcium carbonate, calcium oxide, calcium metasilicate, alumina trihydrate, cryolite, magnesia, kaolin, quartz, and glass. Fillers that can function as grinding aids include cryolite, potassium fluoroborate, feldspar, and sulfur. Fillers can be used in amounts up to about 400 parts, preferably from about 30 to about 150 parts, per 100 parts of the make or size coat precursor, while retaining good flexibility and toughness of the cured coat. The amounts of these materials are selected to provide the properties desired, as known to those skilled in the art.

Organic solvent and/or water may be added to the precursor compositions to alter viscosity. The selection of the particular organic solvent and/or water is believed to be within the skill of those practicing in the field and depends upon the thermosetting resin utilized in the binder precursor and the amounts of these resins utilized.

General Method of Making

The make coat of the various embodiments described herein may be applied using conventional coating techniques including, for example, roll coating, spray coating, or curtain coating. Surprisingly, it has been found that when the viscoelastic properties of the make coat composition and the rate of applying the make coat are carefully controlled, the make coat can be applied to the end surfaces of the separated regions without also applying the make coat to the regions between the separated portions using curtain coating.

The abrasive particles may be applied to the make coat using conventional techniques such as drop coating or electrostatic coating.

The structured topography of the active portion of the various embodiments of the invention described herein may be formed using a variety of techniques including cutting the resilient body using, for example, a blade, laser, water jet, or heated wire either before or after the make coat and abrasive particles have been applied to the resilient body. In addition, the surface topography may be formed using a heat molding die having the desired pattern.

Various modifications and alterations to this invention will become apparent to those skilled in the art without departing from the scope and spirit of this invention. For example, it will be recognized that two or more surface of the resilient body may include structured abrasive surfaces and that the abrasive surfaces may include different types and sizes of abrasive particles. It should be understood that the invention is not intended to be unduly limited by the illustrative embodiments set forth herein and that such embodiments are presented by way of example only with the scope of the invention intended to be limited only by the claims set forth herein as follows.

What is claimed is:

1. A hand-held sanding block for abrading a contoured surface, the article comprising:

(a) a resilient body including a plurality of separated portions, the separated portions having raised end surfaces defining an abrasive working surface;

(b) an adhesive make coat on the separated portion end surfaces;

(c) abrasive particles at least partially embedded in the make coat, the abrasive particles having a hardness of at least 1200 Knoops wherein the separated portions are separated by recessed regions which are substantially free of adhesive make coat and abrasive particles.

2. A sanding block as defined in claim 1, wherein the abrasive particles are selected from the group consisting of aluminum oxide, alumina-based ceramics, silicon carbide, zirconia, alumina-zirconia, garnet, diamond, ceria, cubic boron nitride, ground glass, quartz, titanium diboride, sol gel abrasives and combinations thereof.

3. A sanding block as defined in claim 1, wherein the resilient body is a unitary article.

4. A sanding block as defined in claim 3, wherein the resilient body includes a continuous block portion and the separated portions extend outwardly from the block portion.

5. A sanding block as defined in claim 4, wherein the separated portions are spaced.

6. A sanding block as defined in claim 1, wherein the recessed regions are elongated channels.

7. A sanding block as defined in claim 6, wherein the channels have a width of at least about 1 mm.

8. A sanding block as defined in claim 6, wherein the channels have a width of at least about 4 mm.

9. A sanding block as defined in claim 6, wherein the height differential between the recessed region and the separated portion end surface is at least about 2 mm.

10. A sanding block as defined in claim 6, wherein the height differential between the recessed region and the separated portion end surface is at least about 5 mm.

11. A sanding block as defined in claim 9, wherein the separated portion end surfaces include a generally planar area.

12. A sanding block as defined in claim 11, wherein each channel has generally parallel side surfaces perpendicular to the working surface and a generally planar bottom surface perpendicular to the side surfaces, and wherein the regions adjoining the side surfaces and the bottom surface is rounded.

13. A sanding block as defined in claim 12, wherein the region adjoining the side surface and the raised end surface is rounded.

14. A sanding block as defined in claim 6, wherein the channels are provided in a rectilinear grid.

15. A sanding block as defined in claim 14, wherein the channels are arranged diagonal to the sides of the abrasive article.

16. A sanding block as defined in claim 15 wherein the separated portions are protrusions having at least one of a parallel-piped, cylindrical, dome, frusto pyramidal, and frusto conical shape.

17. A sanding block as defined in claim 16, wherein the protrusions comprise a plurality of discrete columns having end surfaces coated with abrasive particles.

18. A sanding block as defined in claim 17, wherein the raised end surfaces of the columns are generally planar.

19. A sanding block as defined in claim 17, wherein the raised end surfaces of the columns are rounded or dome-like.

20. A sanding block as defined in claim 6, wherein the channels are generally parallel and the separated portions are elongated ridges.

21. A sanding block as defined in claim 20, wherein the raised end surfaces of the ridges are generally planar.

22. A sanding block as defined in claim 20, wherein the raised end surfaces of the ridges are rounded.

23. A sanding block as defined in claim 1, wherein the separated portions abut one another.

24. A sanding block as defined in claim 23, wherein the body includes a plurality of substantially parallel slits and extending the length of the abrasive article.

25. A sanding block as defined in claim 24, wherein the body further includes a plurality of substantially parallel slits extending the width of the abrasive article.

26. A sanding block as defined in claim 4, wherein the block portion has a thickness of at least about 10 mm.

27. A sanding block as defined in claim 1, wherein the abrasive article has an overall thickness of at least about 20 mm.

28. A sanding block as defined in claim 1, wherein the abrasive article is sized to be manually graspable in a user's hand.

29. A sanding block as defined in claim 28, wherein the abrasive article has a width of at least 2 inches (50 mm) and a length of at least 3 inches (76 mm).

30. A sanding block as defined in claim 1, wherein the resilient body is formed of foam having a density of at least 4 pcf.

31. A sanding block as defined in claim 30, wherein the resilient body is formed of an open cell polyurethane foam.

32. A sanding block as defined in claim 1, wherein the abrasive particles have a hardness of at least 2,000 Knoops.

33. A sanding block as defined in claim 1, wherein the abrasive particles have a hardeness of at least 2,400 Knoops.

34. A sanding block as defined in claim 1, wherein the resilient body is a closed cell foam.

35. A hand-held abrasive article for abrading a surface, the article comprising:

(a) a resilient foam body having a density of at least 4 pounds per cubic foot, the body further including a block portion and a plurality of separated portions, the separated portions having raised end surfaces defining an abrasive working surface;

(b) an adhesive make coat directly on the resilient foam body at the separated portion end surfaces; and (c) abrasive particles having a hardness of at least 1200 Knoops at least partially embedded in the make coat;

wherein the separated portions are separated by regions which are substantially free of adhesive make coat and abrasive particles.

36. An abrasive article comprising:

(a) a resilient body including a plurality of separated portions; and (b) an abrasive member arranged adjacent the separated portions;

wherein the abrasive member comprises a flexible sheet substrate comprising a multiplicity of separated resilient bodies connected to each other in a generally planar array in a pattern which provides open spaces between adjacent connected bodies, each body having a first surface and an opposite second surface.

37. An abrasive article as defined in claim 36, wherein the separated portions are spaced.

38. A method of making a hand-held abrasive article, comprising the steps of:

(a) providing a resilient body having an abrasive surface; and (b) removing material from the abrasive surface and the underlying resilient body to form non-abrasive and non-adhesive recessed regions between the separated portions to form discrete separated portions having abrasive end surfaces wherein the abrasive end surfaces comprise abrasive particles having a hardness of at least 1200 Knoops.

39. A method of making a hand-held abrasive article, comprising the steps of:

(a) providing a resilient body;

(b) shaping the resilient body to include a plurality of raised regions separated by recessed regions;

(c) selectively coating the raised regions of the resilient body with an adhesive make coat directly onto the resilient body without coating the recessed regions with the adhesive make coat; and (d) depositing abrasive particles on the make coat of the raised regions, wherein the abrasive particles have a hardness of at least 1200 Knoops.

* * * * *

UNITED STATES PATENT AND TRADEMARK OFFICE

CERTIFICATE OF CORRECTION

PATENT NO. : 7,169,029 B2
APPLICATION NO. : 11/016141
DATED : January 30, 2007
INVENTOR(S) : Petersen et al.

It is certified that error appears in the above-identified patent and that said Letters Patent is hereby corrected as shown below:

Column 15,
Claim 33, Line 57, delete hardeness" and insert --hardness--, therefor.

Column 16,
Claim 35, Line 15, after "by" insert --recessed--.

Signed and Sealed this

Seventeenth Day of April, 2007

JON W. DUDAS
*Director of the United States Patent and Trademark Office*